United States Patent [19]

Williamson

[11] Patent Number: 4,800,281

[45] Date of Patent: Jan. 24, 1989

[54] COMPACT PENNING-DISCHARGE PLASMA SOURCE

[75] Inventor: Weldon S. Williamson, Malibu, Calif.

[73] Assignee: Hughes Aircraft Company, Los Angeles, Calif.

[21] Appl. No.: 922,582

[22] Filed: Oct. 24, 1986

Related U.S. Application Data

[63] Continuation-in-part of Ser. No. 653,615, Sep. 24, 1984, abandoned.

[51] Int. Cl.[4] ..... H01J 27/00

[52] U.S. Cl. ..... 250/427; 250/423 R; 315/111.81

[58] Field of Search ..... 250/423 R, 427, 423 F; 313/362.1, 337, 339, 346 R, 643; 315/111.81

[56] References Cited

U.S. PATENT DOCUMENTS

| | | | |
|---|---|---|---|
| 2,733,348 | 1/1956 | Lawton et al. | 250/427 |
| 3,515,932 | 6/1970 | King | 313/339 |
| 3,610,985 | 10/1971 | Fleming et al. | 250/427 |
| 4,400,648 | 8/1983 | Taguchi et al. | 313/346 R |
| 4,481,062 | 11/1984 | Kaufman et al. | 313/362.1 |

*Primary Examiner*—Bruce C. Anderson

*Attorney, Agent, or Firm*—Terje Gudmestad; V. D. Duraiswamy; A. W. Karambelas

[57] ABSTRACT

A compact, quick-igniting, and high-efficiency Penning-discharge type plasma source which comprises a cathode means for thermionically emitting electrons; an electron emission means disposed inside the cathode; anode means defining a discharge space, for accelerating electrons emitted by said cathode means and said emission means into the discharge space; means for supplying gas to be ionized to the discharge space; and heating means for initially heating the emission means. In a preferred embodiment, the anode means is a planar anode. Initial heating of the emission means by the heater causes electrons to be emitted therefrom. These electrons are accelerated by the planar anode to ionize the gas in the discharge space. An axial magnetic field with axial maximum near the exit aperture in the planar anode optimizes ionization and causes most of the plasma production to occur near the exit aperture, thereby enhancing efficiency of the source. Most of the ions produced exit the source before recombination. The other ions impact the cathode, cause heating and induce thermionic emission, thereby rendering further heating of the emission means unnecessary. A method of igniting a Penning-discharge type plasma source is also provided.

16 Claims, 3 Drawing Sheets

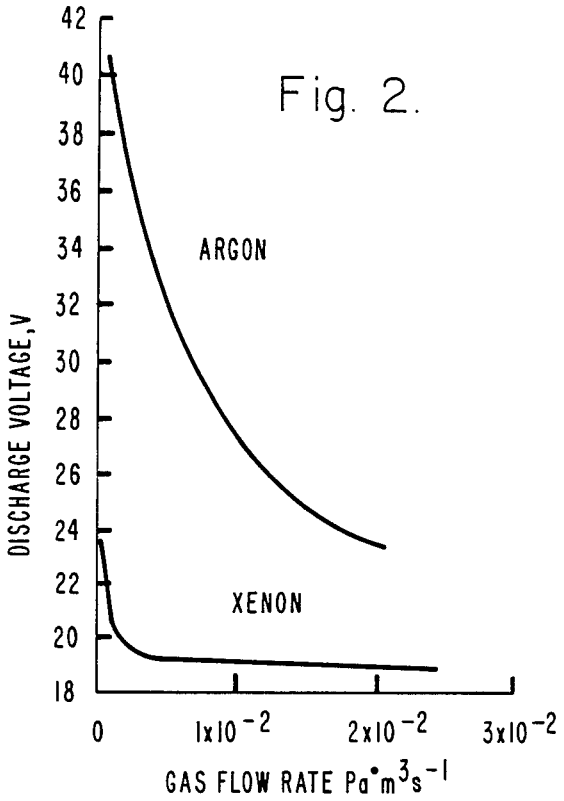
Fig. 3.
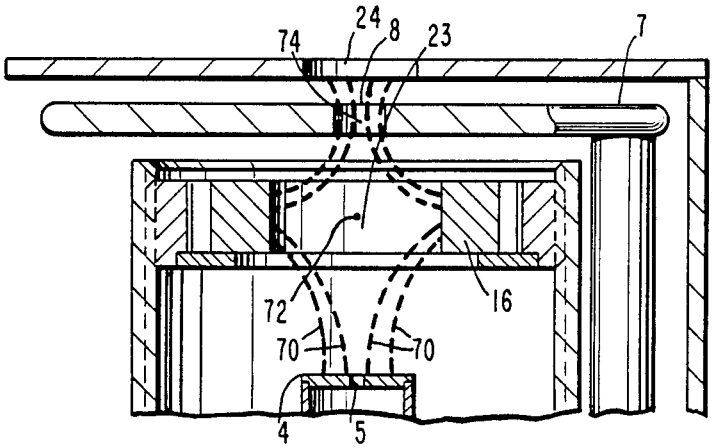

COMPACT PENNING-DISCHARGE PLASMA SOURCE

This application is a continuation-in-part of pending application Ser. No. 06/653,615, filed on Sept. 24, 1984.

BACKGROUND OF THE INVENTION

1. Field of the Invention

The present invention relates in general to plasma generators and, in particular, to plasma generators utilizing Penning-discharge type configurations using dc discharges and magnetic fields to enhance electron confinement.

2. Description of the Related Art

Orbiting spacecraft travelling through space plasma build up high potentials on their outer surfaces which are often made of insulating materials, due to bombardment by both negative and positive particles. Such potentials are often localized on a particular portion of the spacecraft, which results in different areas of the spacecraft's outer shell being charged to different voltage potentials. For example, in a nonspinning spacecraft in solar orbit, one side faces the sun and one faces darkness. The side of the spacecraft which faces the sun will not become charged, because radiant solar energy causes photoelectrons to be emitted from the spacecraft's surface, and this photoemission compensates for the incident electrons, thereby limiting charge buildup on that side of the spacecraft. The dark side, however, can become charged to very large negative potentials, e.g., −10 kilovolts.

The difference in potential between various areas on the spacecraft's surface can cause an electrical discharge therebetween, which can damage electronic equipment on the spacecraft.

Alternatively, particle bombardment can result in the entire spacecraft being charged to a different potential than space plasma, which could, for example, have an adverse effect on scientific satellites which measure the ambient environment around the spacecraft.

Plasma sources, which produce positive ions and electrons, have been used to discharge the surface of a spacecraft and to clamp the spacecraft to space potential. Such plasma sources discharge the spacecraft because the emitted electrons will be attracted to the positively charged side of the spacecraft while the emitted ions will be attracted to the negatively charged side of the spacecraft, thereby bringing the spacecraft's surfaces to the same potential. In addition, the plasma source clamps the spacecraft frame to space potential because the emitted plasma provides a conductive bridge to the space plasma.

Prior plasma sources have suffered from the disadvantages of being slow to ignite and of providing a low ion emission current, in addition to being relatively large devices In prior hollow-cathode type Penning-discharge devices, the cathodes require constant heating, to effect thermionic emission of electrons, each time the plasma source is to be used. This can result in the power consumption of the plasma source being on the order of 20 watts and several minutes being required to heat the cathode to ignition temperature.

Accordingly, it is the primary object of the present invention to reduce the size, ignition time, and gas and power consumption of a Penning-discharge type plasma source, while achieving large electron and ion currents.

SUMMARY OF THE INVENTION

The present invention, in a broad aspect, is a Penning-discharge type plasma source including a cathode for thermionically emitting electrons, an electron emission means disposed inside the cathode for thermionic electron emission, anode means for accelerating electrons emitted by the cathode and by the emission means to a discharge space defined by the anode means, means for supplying gas to be ionized into the discharge space, as well as a heater for heating the emission means and magnet means for providing a magnetic field in said discharge space to increase ionization of the gas. Initial heating of the emission means by the heater causes electrons to be emitted therefrom. The emitted electrons are accelerated by the positively-charged planar anode to ionize the gas in the discharge space, with some of the ions being accelerated out of the source and with other of the ions impacting the cathode to effect heating thereof to cause thermionic emission. As a result, the ionization of the gas continues and further heating of the emission means is unnecessary.

In accordance with one feature of the invention, the anode is a planar anode. The planar anode and the magnetic field provided in the discharge space to increase the ionization of the gas therein, cause a large fraction of the plasma production to occur near the exit orifice of the plasma source. It is a purpose of the present invention to provide a plasma source particularly suited for applications such as spacecraft charging control. In such applications, no ion-beam-accelerating component is used with the plasma source, and therefore the ions exit from the plasma source by diffusion or under the influence of the weak electric fields associated with spacecraft charging. The present invention produces most of the plasma near the exit orifice of the plasma source, and thereby makes a larger percentage of the plasma produced available for spacecraft charging control purposes even without additional accelerating components.

In accordance with another feature of the invention, the cathode is a hollow cathode and the emission means is a foil insert of tantalum material containing a barium compound disposed within the cathode for ignition of the device.

In accordance with yet another feature of the invention, a plurality of samarium-cobalt magnets encircle the discharge space to increase ionization of the gas and to effect the Penning discharge.

The present invention also provides a novel method of igniting a Penning-discharge plasma source of the type containing a thermionic cathode for emitting electrons, and an anode for accelerating the electrons into a discharge space receiving a gas flow, to effect ionization of the gas. The method includes placing an electron emissive cathode insert surface into the cathode, applying a discharge potential across the discharge space to initiate ionization of the gas, and then admitting a brief burst of high-pressure gas into the interspace between the cathode and keeper-electrode, when a keeper electrode is used, which is optional, or between the cathode and the anode. This precipitates an arc-discharge between the emissive surface of the cathode insert and either the keeper electrode or the planar anode. The arc-discharge rapidly heats the cathode insert to thermionic emission temperature, at which point normal hollow-cathode operation is established. This method of ignition enables the source to be brought into full operation within approximately one second.

It is a purpose of the present invention to provide a plasma source which is capable of producing a relatively large ion current with very modest input power requirements.

Another purpose of the present invention is to provide a plasma source which achieves very rapid ignition when started-up from a cold condition.

Furthermore, the plasma source of the present invention has a long life-time, and the plasma produced is low energy plasma.

The present invention, by virtue of the features and purposes enumerated above, is particularly well-suited for spacecraft charging control. However, the usefulness of the present invention is by no means limited to spacecraft charging control, but extends also to other applications requiring efficient, low energy plasma production.

Other purposes, features, and advantages of the present invention will become apparent from the consideration of the following detailed description and from the accompanying drawings.

BRIEF DESCRIPTION OF THE DRAWINGS

FIG. 2 shows characteristics of the plasma source shown in FIG. 1 in operation with argon and xenon gases.

FIG. 3 shows the magnetic field provided inside the plasma source shown in FIG. 1.

DETAILED DESCRIPTION

Figure 1:
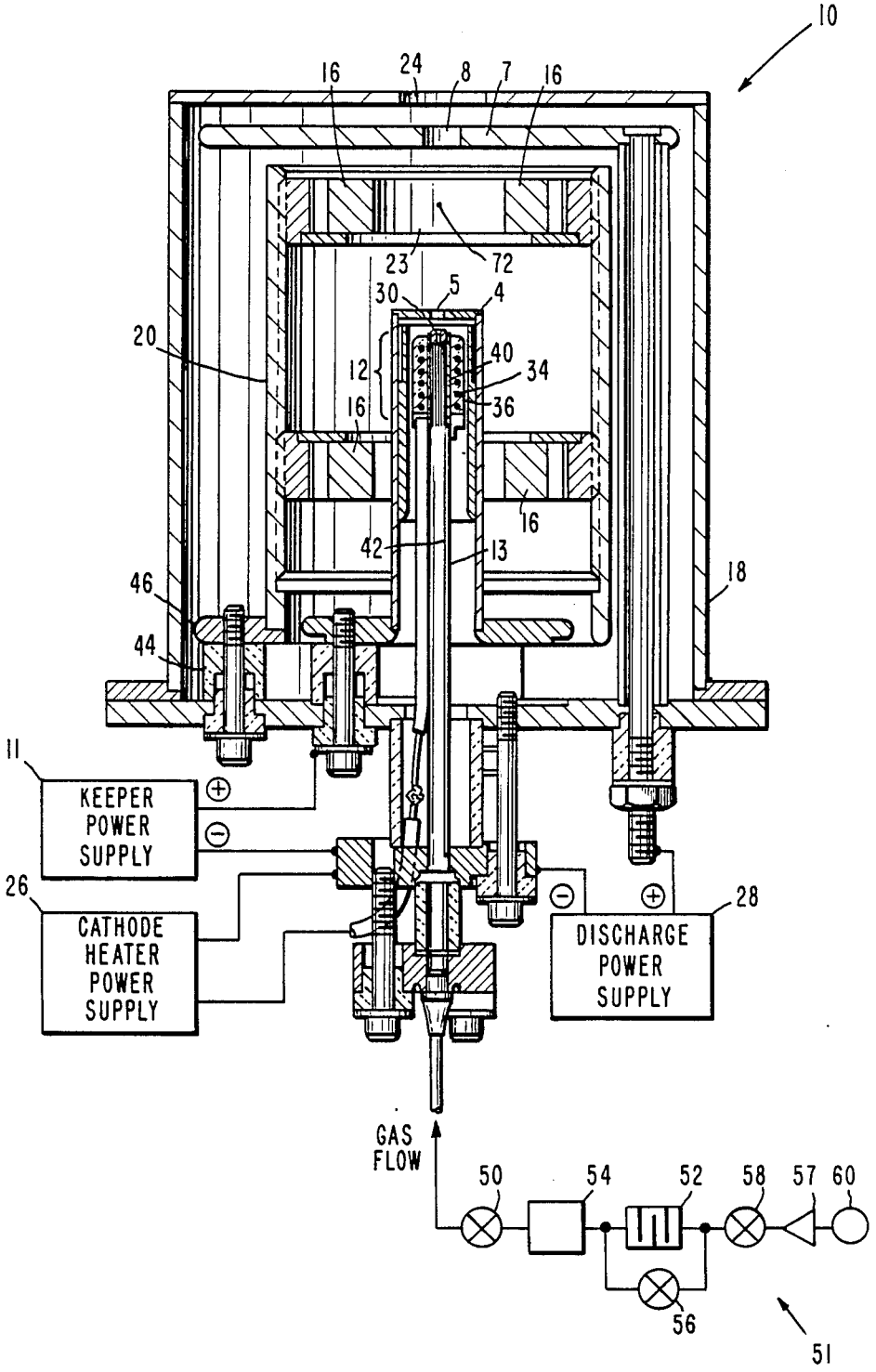
FIG. 1 shows a schematic view of a Penning-discharge plasma source according to the present invention.

Referring more particularly to the drawings, FIG. 1 shows a compact Penning-discharge plasma source 10 according to the present invention. The plasma source 10 has the characteristics of low power consumption, high gas efficiency, long cathode lifetime, as well as being compact and low in mass. The plasma source 10 comprises a cylindrical cathode 12 which may be on the order of 3 mm in diameter. The cylindrical cathode 12 conducts gas admitted into it via a cathode tube 13 to a discharge space 23. The discharge space 23 is defined on one side by planar anode 7.

Although the preferred embodiment of the present invention features a planar anode, shown in FIG. 1 and discussed below, a cylindrical anode can also be used in an alternative embodiment. When a cylindrical anode is used, discharge space 23 is defined by the portion of the cylindrical anode which is above the cathode 12.

Magnets 16 in a ring configuration are located at two axial and several azimuthal positions. Magnets 16 may be samarium-cobalt ($SmCo_5$) magnets or other permanent magnets or electromagnets with pole-pieces placed in a ring configuration, and are placed so that one ring is adjacent to planar anode 7 and is downstream with respect to the gas flow, whereas the other ring of magnets 16 is upstream with respect to the gas flow, that is, closer to the tip 30 of cathode 12 and the point at which the gas is introduced into cathode 12. These magnets 16 provide a strong divergent axial magnetic field to increase the iongeneration capability of the source 10. Magnetic flux is returned through an iron shield 20 which also retains the magnets and reduces the stray magnetic field leaving the plasma source 10. The iron shield 20 is in turn surrounded by an outer enclosure 18 which is at cathode (common) potential. (Common potential is typically connected to spacecraft ground through current detectors which measure the plasma-source emission current.)

Iron shield 20 is secured to and electrically isolated from outer enclosure 18 by insulating mountings 44. In the preferred embodiment an annular seating ridge 46 is used to assure rigidity in the shield and enclosure structure for the rigors of spacecraft use.

The plasma source enclosure 18 comprises a sealed cylinder with a plasma exit-orifice 24, which is the only unsealed opening. This orifice 24 may be covered during launch by a blowopen cover (not shown) to protect the source from contamination. A vacuum seal can also be made to the flange of the orifice 24 to permit evacuating the plasma source and operating it on the ground for pre-launch checkout.

Internally, the plasma source 10 may be supported by ceramic insulators or other means known in the art which allow the anode 7, the outer enclosure 18, and spacecraft ground to be at different electrical potentials.

Figure 4:
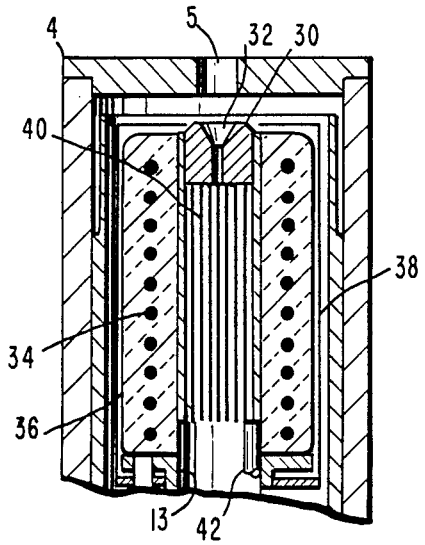
FIG. 4 shows in greater detail the cathode portion of the device shown in FIG. 1.

The cathode 12 includes a tip portion 30 having an orifice 32 of smaller diameter than that of the cathode 12 as shown in FIG. 4. A cathode heater 36, including a plurality of heating coils 34 and a radiation shield 38 is used for first-time-only "conditioning" of the cathode. The cathode heater 36 is connected to a cathode heater supply 26. A discharge supply 28 is connected between the cathode 12 and the anode 7 to ignite the source.

A cathode insert 40, which may be a tantalum-foil insert, is utilized in the ignition of the source 10, as explained in more detail below.

In the preferred embodiment, insert 40 is a tantalum foil coiled up in layers about a central axis so as to form a cylinder. There are spaces between the adjacent tantalum layers of insert 40 to provide egress for escaping electrons. The tantalum foil of insert 40 is attached to a support 42 which secures insert 40 to the walls of cathode tube 13. Insert 40 is covered with a barium-containing compound to reduce its work function, thereby allowing electron emission at relatively low temperatures, on the order of approximately 900 degrees Celsius. This insert 40 eliminates the need for heating of the cathode by an external supply as employed in the prior art.

The cathode tip 30 may be made of impregnated porous tungsten material which is capable of thermionic emission. The cathode insert 40 can also comprise an impregnated porous tungsten matrix insert with a tantalum foil extension having the barium coating. The anode 7 can be made of a molybdenum material, although the anode material is not especially critical.

Concerning the cathode heater supply 26 and discharge supply 28, both are conventional. The heater supply 26 can be an AC on a DC supply providing the necessary current to the heating coils 34. The discharge supply is designed to provide from several hundred to 1000 volts at extremely low current to light the initial discharge, and then to provide a lower voltage, e.g., 20–30 volts, and a somewhat higher current, on the order of 200–500 mA, to maintain the discharge. The keeper power supply 11 and discharge supply 28 are designed to limit both the energy and current during the gas-burst ignition to avoid arc damage to the cathode insert 40.

In normal steady-state operation, xenon or argon gas is admitted by a gas-feed system 51 into the cathode tube 13 for passage through the cathode orifice 32 into the discharge space 23 where ionization occurs. Electrons are emitted thermionically from the cathode insert 40. Electrons leaving the cathode orifice 32 are accelerated to the potential of the plasma in the discharge space 23, which is near anode potential. The electrons then oscillate axially between the cathode tip 30 and the outer shield 18, both of which the electrons are energetically unable to reach. The electrons are confined radially by a strong magnetic field which is produced by the two magnetic rings 16, the magnetic flux of which is linked externally by the iron magnetic shield 20. This magnetic field is illustrated in FIG. 3 by dashed lines 70, and exhibits a cusped-shaped null point 72 and an axial maximum 74 near the aperture 8 in anode 7. This magnetic field geometry causes most of the plasma produced by the source to be generated in the region between points 72 and 74. Therefore this plasma has a high likelihood of exiting before recombination through exit orifice 24 which is at ground potential. Thus, this arrangement results in plasma being formed near the exit aperture in the anode, thereby resulting in a significant increase in the ratio of the plasma-production-rate to the input power. This is a significant improvement over prior devices wherein the magnetic-field and anode geometries cause the region of highest plasma production to occur deep inside the source and further away from the exit aperture. This increases the probability of the plasma undergoing wall recombination before leaving the source, and thereby decreases the ratio of plasma production to input power of the source. This causes such sources to consume excessive power for the ion current produced. Moreover, in the present invention, this improvement in efficiency of production of plasma flux is achieved without the use of ion accelerating extraction grids near the exit aperture. Use of ion extraction grids typically increases power and gas flow rate requirements and results in a high energy ion beam which is not suitable for spacecraft charging control applications.

Thus, in the discharge space 23, the electrons are trapped by the magnetic and electrostatic mechanisms until they undergo collisions with the gas that fills the discharge space 23. These collisions have a high probability of producing new electron-ion pairs, resulting in a relatively high ion-generation rate.

Some of the ions which are formed in the discharge space impact the cathode tip 30, and maintain its temperature at a level consistent with thermionic electron emission. The electric fields produced by the charged surfaces cause the other ions to leave the plasma source via the exit aperture 24 in the outer shield 18, and these ions are attracted by and neutralize the negatively charged spacecraft surfaces. Electrons also leave by the exit aperture 24, and they are accelerated away from the spacecraft until charge neutrality is accomplished.

The cathode 12 is ignited by a unique 'gas-burst' method. A conventional gas feed system 51 is used. Gas from a tank 60 passes through a pressure-reducing regulator 57 through a high pressure valve 58, a bypass valve 56 and into a burst reservoir 54. With low-pressure valve 50 closed, when the burst reservoir 54 is filled to equilibrium pressure, bypass valve 56 is closed. To ignite the cathode 12 and thereby activate source 10, a high voltage, on the order of about 1000 volts, is applied to keeper electrode 4 by keeper power supply 11. Valve 50 is then opened. High pressure gas then rushes from reservoir 54 into the cathode 12—keeper electrode 4 interspace and initiates an arc discharge between the cathode insert 40 and the keeper electrode 4. The arc discharge rapidly heats the cathode insert 40 to a temperature near 1000° C., at which point the discharge changes from an arc discharge to a thermionic hollow-cathode discharge. When the transition is complete, the cathode-to-keeper voltage falls to a small value, typically 15 V. During this time, the supply high-pressure gas from the reservoir 54 is exhausted, and the gas flowrate reaches equilibrium at a low rate which is determined by the characteristics of the flow impedance 52, and is typically on the order of $8\times10^{-4}$Pam$^3$s$^{-1}$ or 0.5 standard cm$^3$ per minute.

Thermionic hollow-cathode operation produces a partially ionized plasma in the cathode-keeper interspace. This plasma is the source of electrons which flow through the orifice 5 in the keeper electrode 4 into the discharge space 23 when a positive voltage, typically about 20 V, is applied to the anode 7 from the discharge supply 28.

First time ignition of the plasma source is initiated by briefly heating the heating coils 34 in the cathode heater 36 using the cathode heater supply activates the emissive compound in the insert 40 and causes electrons to be emitted from it. A large (approximately 1 kilovolt) potential difference is then applied by the discharge supply 28 between the anode and the cathode, and a brief burst of higher than normal gas flow is admitted by the gas feed system 51 as described earlier. The high potential difference from the discharge supply 28 initiates the Penning discharge. The discharge power supply characteristic is chosen to cause a rapid transition to low discharge voltages (approximately 20 volts) as the discharge ignites. Subsequent ignitions of the plasma source are accomplished by the foregoing procedure, but without the need to heat cathode heater 36 with cathode heater supply 26.

As seen from the foregoing, the cathode heater 36 is merely used to condition the cathode (i.e., thermally reduce the emissive compound) in preparation for the first ignition in space. It is not used afterwards, except in the event of cathode contamination.

The plasma source 10 just described is an exceptionally compact, fast-starting, low-power plasma source which is capable of delivering relatively large electron and ion currents. The plasma source 10 has the unique advantages of high ion-emission current capability (greater than 1 mA), low power and gas consumption (less than 15 watts and less than $8.5\times10^{-4}$ Pa·m$^3$s$^{-1}$ of gas), and rapid ignition (less than 1 second). These attributes make plasma source 10 especially well-suited to the spacecraft charge-neutralization application because it places a minimum power and mass burden on the host spacecraft. Additionally, the expected lifetime is greater than 20,000 hours, with an expected restart capability of greater than 10,000 starts.

Furthermore, the lower operating discharge voltage, on the order of 25 V of the present invention significantly reduces sputtering. Sputtering is a problem when conventional ion sources with typically higher discharge voltages on the order of 40 volts are used in spacecraft. At the higher voltages there is generally a significant amount of sputtering of the cathode and other surfaces at the cathode potential.

FIG. 2 shows the characteristics of the plasma source 10 in operation with both argon and xenon gases. The advantages of operation with xenon are apparent in FIG. 2. Lower discharge voltages (and consequently, lower power consumption) are achieved at a given gas flow rate than with argon. This advantage is associated with the higher atomic mass of xenon. An operating point near the "knee" of the voltage-flow characteristic will afford a low discharge voltage and a relative insensitivity to small changes in flow without the high-flow rate penalty which is associated with operating on the flat portion of the curve. Hollow cathode type sources are most often operated in this "knee" region of the voltage-flow rate characteristic.

The gas feed system 51 referred to above, which is not part of the present invention, is also conventional and provides the following two characteristics. First, feed system 51 provides a low constant gas flow rate during plasma source 10 operation, for example, a xenon flow rate of approximately $8.5\times10^{-4}$ Pa·m$^3$s$^{-1}$. Second, in order to accomplish reliable ignition of plasma source 10, a brief initial burst of gas at a higher pressure than is needed during normal sustained-running operation can be injected by feed system 51.

Lastly, by using electromagnets as the magnets 16, the magnetic field surrounding the anode 7 can be adjusted and therefore act as throttle control for large ion emission current capability. The separate keeper electrode 4 in the ion source shown in FIG. 1, and adjustment of the ion-emission current by varying the discharge current may also be used as a throttle mechanism in the present invention. If adjustment of the discharge current is used as the throttling mechanism, then the keeper electrode is needed to sustain cathode operation when the discharge current is reduced. In alternative embodiments, the separate keeper electrode can be omitted. When a keeper electrode is not included, to ignite the source using the gas-burst method, the high voltage on the order of about 1000 volts earlier described as being applied to keeper electrode 4 is applied instead to the anode 7. The ignition steps remain basically the same. When the transition is complete, the cathode-to-anode voltage falls to a low value, typically 25 volts.

To illustrate the peformance characteristics of the plasma source 10, typical operating parameters in steady-state operation are given below. These parameters are being provided merely by way of example and not as limitations. These values correspond to operation with the preferred operating gas, which is a 90%-xenon and 10%-hydrogen mixture. With zero cathode-heater power, a keeper electrode current of about 0.25 A and voltage of about 19.0 V, a discharge current of about 0.2 A and discharge voltage of about 23.5 V, an ionemission current of about 0.001 A can be obtained with modest total input power of about 9.5 W and a low gas flow rate of approximately $8\times10^{-4}$ Pam$^3$s$^{-1}$.

In the foregoing description of the present invention, a preferred embodiment of the invention has been disclosed. It is to be understood that other mechanical and design variations are within the scope of the present invention. Accordingly, the invention is not limited to the particular arrangement such as has been illustrated and described in detail herein.

What is claimed is:

1. A plasma source housed in an outer enclosure comprising:

a tubular cathode having a tip defining an orifice disposed inside said enclosure for thermionically emitting electrons;

electron emission means comprising foil means disposed within said cathode adjacent said orifice;

a planar anode having an exit aperture, said anode and cathode being coaxially disposed with a discharge space therebetween, said anode accelerating electrons emitted by said cathode and said emission means into said discharge space;

a first plurality of magnets disposed in a first ring configuration axially with and adjacent to said anode;

a second plurality of magnets disposed in a second ring configuration axially with and adjacent to said cathode;

said first and second ring configuration providing a strong divergent axial magnetic field having an axial maximum adjacent to the exit aperture in said anode, and having an axially minimum a short distance in front of said anode in said discharge space;

discharge power supply means for supplying a relatively high voltage to start discharge in said discharge space and for supplying a reduced voltage to maintain discharge during steady state operation;

means for supplying gas to be ionized to said discharge space including gas control means for supplying gas at a constant rate during steady state operation of said plasma source and at an increased rate during ignition of said source; and heating means for initially heating and conditioning said emission means.

2. A plasma source as defined in claim 1, wherein said first and second plurality of magnets are samarium-cobalt magnets.

3. A plasma source as defined in claim 1, wherein said first and second plurality of magnets comprises electromagnetic means.

4. A cathode source as defined in claim 1 further comprising keeper electrode means positioned adjacent to said cathode for accelerating electrons emitted by said cathode and said emission means into said discharge space.

5. A plasma source as defined in claim 1, further comprising keeper electrode means positioned adjacent to said cathode for providing a throttle mechanism in conjunction with adjustment of the discharge current.

6. A plasma source housed in an outer enclosure comprising:

a hollow cathode having a tip defining an orifice disposed inside said enclosure for thermionically emitting electrons;

electron emission means comprising foil means disposed within said cathode adjacent said orifice;

a planar anode having an exit aperture disposed exteriorly of said cathode with a discharge spaced being provided for accelerating electrons emitted by said cathode and said emission means into said discharge space;

a first magnetic ring coaxially disposed adjacent to said anode;

a second magnetic ring coaxially disposed adjacent to said cathode;

said first and second magnetic rings providing a strong divergent axial magnetic field having an axial maximum adjacent to the exit aperture in said anode;

discharge power supply means for supplying a relatively high voltage to start discharge and for supplying a reduced voltage to maintain said discharge in said discharge space during steady state operation;

means for supplying gas to be ionized to said discharge space including gas control means for supplying gas at a constant rate during steady state operation of said plasma source and at an increased rate during ignition of said source; and heating means for initially heating said emission means and causing electrons to be emitted therefrom, which electrons are accelerated by said anode means to ionize said gas, with some of said ions being accelerated out of said source and with other ions impacting said cathode to heat said cathode to effect thermionic emission by said cathode which continues ionization of said gas.

7. A plasma source as defined in claim 6, wherein said first and second rings comprise a plurality of magnets disposed in ring configurations.

8. A plasma source as defined in claim 6, wherein said first and second magnetic ring comprise electromagnetic means.

9. A cathode source as defined incline 6 further comprising keeper electrode means positioned adjacent to said cathode for accelerating electrons emitted by said cathode and said emission means into said discharge space.

10. A plasma source as defined in claim 6, further comprising keeper electrode means positioned adjacent to said cathode for providing a throttle mechanism in conjunction with adjustment of the discharge current.

11. A plasma source housed in an outer enclosure comprising:

a tubular cathode and adjacent said orifice disposed inside said enclosure for thermionically emitting electrons;

electron emission means disposed inside said cathode and adjacent said orifice for thermionically emitting electrons;

a planar anode having an aperture therethrough, said anode being coaxially disposed exteriorly of said cathode and defining a discharge space therebetween, said anode accelerating electrons from said cathode and emission means into said discharge space;

means for supplying gas to be ionized to said discharge space at a constant rate during steady state operation of said plasma source and at an increased rate during ignition of said source;

a plurality of magnets disposed in ring configurations in at least two axial and a plurality of azimuthal positions exteriorly of said cathode means, for providing a strong divergent axial magnetic field having an axial maximum adjacent to the exit aperture of said anode and an axial minimum a short distance in front of said aperture in said discharge space;

heating means for initially heating said emission means;

voltage supply means for supplying a large potential difference between said cathode and said anode during ignition of said source; and current supply means for supplying current to maintain said discharge during steady state operation.

12. A plasma source as defined in claim 11 further comprising keeper electrode means positioned adjacent to said cathode for accelerating electrons emitted by said cathode and said emission means into said discharge space.

13. A plasma source as defined in claim 1 wherein said cathode comprises a generally hollow cathode with a tip defining an orifice, and said electron emission means comprises foil means disposed within said cathode adjacent said orifice, and said planar anode comprises a circular anode disposed exteriorly of said Cathode with the discharge space being provided axially between said cathode orifice and said anode.

14. A plasma source as defined in claim 13 wherein said foil means comprises tantalum foil means.

15. A plasma source as defined in claim 11 wherein said magnets comprise a plurality of samarium-cobalt magnets.

16. A plasma source as defined in claim 11 wherein said magnets comprise electromagnetic magnets.

* * * * *